US012747871B2

(12) United States Patent
Maema et al.

(10) Patent No.: US 12,747,871 B2
(45) Date of Patent: Sep. 29, 2026

(54) INDOOR UNIT OF AIR CONDITIONER

(71) Applicant: FUJITSU GENERAL LIMITED, Kanagawa (JP)

(72) Inventors: Yoshinari Maema, Kanagawa (JP); Daiki Shimano, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 107 days.

(21) Appl. No.: 18/846,277

(22) PCT Filed: Mar. 24, 2023

(86) PCT No.: PCT/JP2023/011751
§ 371 (c)(1),
(2) Date: Sep. 12, 2024

(87) PCT Pub. No.: WO2023/190121
PCT Pub. Date: Oct. 5, 2023

(65) Prior Publication Data

US 2025/0207787 A1 Jun. 26, 2025

(30) Foreign Application Priority Data

Mar. 30, 2022 (JP) ..... 2022-056160

(51) Int. Cl.
*F24F 1/0063* (2019.01)
*F24F 1/0003* (2019.01)
(Continued)

(52) U.S. Cl.
CPC ..... *F24F 1/0063* (2019.02); *F24F 1/0003* (2013.01); *F24F 1/0022* (2013.01);
(Continued)

(58) Field of Classification Search
CPC ..... F25B 39/04; F24F 1/0063
See application file for complete search history.

(56) References Cited

U.S. PATENT DOCUMENTS 5,678,417 A * 10/1997 Nigo ..... F24F 3/14 236/44 R
12,000,633 B2 * 6/2024 Adachi ..... F28F 9/0246
(Continued)

FOREIGN PATENT DOCUMENTS

EP 3355023 A1 8/2018
JP 2010-096481 A 4/2010
(Continued)

*Primary Examiner* — Christopher R Zerphey
(74) *Attorney, Agent, or Firm* — Paratus Law Group, PLLC

(57) ABSTRACT

There is provided an indoor unit of an air conditioner to suppress the decrease in the amount of heat exchange between a refrigerant and air due to pressure loss. In the indoor unit of the air conditioner, a second heat exchange part has a high wind velocity region where a wind velocity of air passing through the second heat exchange part is relatively high and a low wind velocity region where the wind velocity of air is relatively low, and the high wind velocity region is located above the low wind velocity region in a direction of gravity. At least one first heat transfer tube is disposed in the high wind velocity region, and at least one second heat transfer tube is disposed in the low wind velocity region. A first header is connected to each of the first heat transfer tube and the second heat transfer tube. The first header has a first internal space to which the first heat transfer tube and the second heat transfer tube are commonly connected. When using a heat exchanger as a condenser, the refrigerant flowed out from a first heat exchange part 110 flows into the first internal space of the first header, and then, the refrigerant flows into each of the first heat transfer tube and the second heat transfer tube from the first internal space.

5 Claims, 5 Drawing Sheets

(51) Int. Cl.

| | |
|---|---|
| ***F24F 1/0022*** | (2019.01) |
| ***F24F 1/009*** | (2019.01) |
| ***F24F 1/06*** | (2011.01) |
| ***F25B 13/00*** | (2006.01) |
| ***F25B 39/02*** | (2006.01) |
| ***F25B 39/04*** | (2006.01) |
| ***F28D 1/053*** | (2006.01) |
| ***F28D 21/00*** | (2006.01) |
| ***F28F 9/02*** | (2006.01) |

(52) U.S. Cl.

CPC ..... *F24F 1/009* (2019.02); *F25B 13/00* (2013.01); *F25B 39/028* (2013.01); *F25B 39/04* (2013.01); *F28D 1/053* (2013.01); *F28F 9/02* (2013.01); *F24F 1/06* (2013.01); *F24F 2221/54* (2013.01); *F28D 2021/0071* (2013.01)

(56) References Cited

U.S. PATENT DOCUMENTS

| | | | | |
|---|---|---|---|---|
| 2015/0101363 | A1* | 4/2015 | Matsuda ..... | F25B 39/04<br>165/174 |
| 2018/0073820 | A1 | 3/2018 | Higashiiue et al. | |
| 2018/0292096 | A1* | 10/2018 | Onaka ..... | F25B 39/02 |

FOREIGN PATENT DOCUMENTS

| | | | |
|---|---|---|---|
| JP | 2010-133656 | A | 6/2010 |
| JP | 5901748 | B | 4/2016 |
| JP | 2017-155993 | A | 9/2017 |
| WO | WO 2016/178398 | A1 | 11/2016 |

* cited by examiner

INDOOR UNIT OF AIR CONDITIONER

CROSS REFERENCE TO PRIOR APPLICATION

This application is a National Stage Patent Application of PCT International Patent Application No. PCT/JP2023/011751 (filed on Mar. 24, 2023) under 35 U.S.C. § 371, which claims priority to Japanese Patent Application No. 2022-056160 (filed on Mar. 30, 2022), which are all hereby incorporated by reference in their entirety.

TECHNICAL FIELD

The present invention relates to an indoor unit of an air conditioner that includes a heat exchanger.

BACKGROUND ART

There is a heat exchanger that includes a plurality of heat transfer tubes lined up in parallel, a pair of headers connected to both ends of each of the plurality of heat transfer tubes, and a heat-dissipating fin that is provided between the pair of headers, the plurality of heat transfer tubes penetrating the heat-dissipating fin. In such a heat exchanger, when the air used for heat exchange passes therethrough, a region where the air flows quickly and a region where the air flows slowly are formed in some cases depending on the shape of the air passage in which the heat exchanger is provided.

Under such circumstances, there is a technology that improves the amount of heat exchange between a refrigerant and air in the entire heat exchanger by adjusting the flow rate of the refrigerant in accordance with the flow velocity distribution of the air passing through the heat exchanger (see, for example, Patent Literature 1). In this technology, for example, by changing the heat transfer area of the region where the flow velocity of air is fast and the heat transfer area of the region where the flow velocity of air is slow, the circulation amount of the refrigerant in the region where the flow velocity of air is fast is increased to increase the amount of heat exchange and make the amount of heat exchange in the region where the flow velocity of air is fast closer to the amount of heat exchange in the region where the flow velocity of air is slow.

CITATION LIST

Patent Literature

Patent Literature 1: Japanese Patent No. 5901748

DISCLOSURE OF INVENTION

Technical Problem

However, in the case where the heat transfer area in the region where the flow velocity of air is fast and the heat transfer area in the region where the flow velocity of air is slow are changed, the pressure loss in the refrigerant flow path increases as the flow velocity of the refrigerant increases in the region where the heat transfer area is reduced. As a result, in the region where the cross-sectional area of the flow path is small, the amount of heat exchange decreases.

In view of the circumstances as described above, it is an object of the present invention to provide an indoor unit of an air conditioner that suppresses the decrease in the amount of heat exchange between a refrigerant and air due to pressure loss.

Solution to Problem

In order to achieve the above-mentioned object, an indoor unit of an air conditioner according to an embodiment of the present invention includes a heat exchanger that includes a first heat exchange part and a second heat exchange part.

The second heat exchange part has a high wind velocity region where a wind velocity of air passing through the second heat exchange part is relatively high and a low wind velocity region where the wind velocity of air is relatively low, and the high wind velocity region is located above the low wind velocity region in a direction of gravity.

At least one first heat transfer tube is disposed in the high wind velocity region, and at least one second heat transfer tube is disposed in the low wind velocity region.

A first header is connected to each of the first heat transfer tube and the second heat transfer tube.

The first header has a first internal space to which the first heat transfer tube and the second heat transfer tube are commonly connected.

When using the heat exchanger as a condenser, the refrigerant flowed out from the first heat exchange part flows into the first internal space of the first header, and then the refrigerant flows into each of the first heat transfer tube and the second heat transfer tube from the first internal space.

In accordance with such an indoor unit of an air conditioner, the decrease in the amount of heat exchange between a refrigerant and air due to pressure loss is suppressed.

In the indoor unit of an air conditioner, the first header may be provided with an inflow port into which the refrigerant flowed out from the first heat exchange part flows, and the inflow port may be disposed in a lower part of the first header in the direction of gravity.

In accordance with such an indoor unit of an air conditioner, the decrease in the amount of heat exchange between a refrigerant and air due to pressure loss is further suppressed.

The indoor unit of an air conditioner may further include: a casing that houses the heat exchanger and includes an inlet port into which the air is inhaled and an outlet port from which the air is blown out; and an indoor fan that is housed in the casing, inhales in the air via the inlet port, and blows out the air that passes through the heat exchanger via the outlet port, the casing including a guide plate that guides the air that passes through the heat exchanger to the outlet port, the guide plate being provided between the low wind velocity region of the second heat exchange part and the fan.

In accordance with such an indoor unit of an air conditioner, the decrease in the amount of heat exchange between a refrigerant and air due to pressure loss is further suppressed.

The indoor unit of an air conditioner may further include a casing that houses the heat exchanger and includes an inlet port into which the air is inhaled and an outlet port from which the air is blown out, the casing including a drain pan that collects condensed water flowing down from the second heat exchange part, the low wind velocity region being located closer to the drain pan than the high wind velocity region.

In accordance with such an indoor unit of an air conditioner, the decrease in the amount of heat exchange between a refrigerant and air due to pressure loss is further suppressed.

In the indoor unit of an air conditioner, the first heat exchange part may include a second header that allows the refrigerant to flow out when the heat exchanger is used as a condenser, the second header may have a plurality of second internal spaces divided by at least one partition plate, and a volume of the first internal space may be larger than each of volumes of the plurality of second internal spaces.

In accordance with such an indoor unit of an air conditioner, the decrease in the amount of heat exchange between a refrigerant and air due to pressure loss is further suppressed.

In the indoor unit of an air conditioner, each of the plurality of second internal spaces may be connected to the first internal space via a pipe.

In accordance with such an indoor unit of an air conditioner, the decrease in the amount of heat exchange between a refrigerant and air due to pressure loss is further suppressed.

Advantageous Effects of Invention

As described above, in accordance with the present invention, there is provided an indoor unit of an air conditioner that suppresses the decrease in the amount of heat exchange between a refrigerant and air due to pressure loss.

MODE(S) FOR CARRYING OUT THE INVENTION

Embodiments of the present invention will be described below with reference to the drawings. Further, the same members or members having the same function are denoted by the same reference symbols in some cases, and the description is omitted as appropriate after the members are described. Further, when numerical values and numbers are illustrated below, the values are illustrative and are not limited to the numerical values and numbers.

Figure 1:
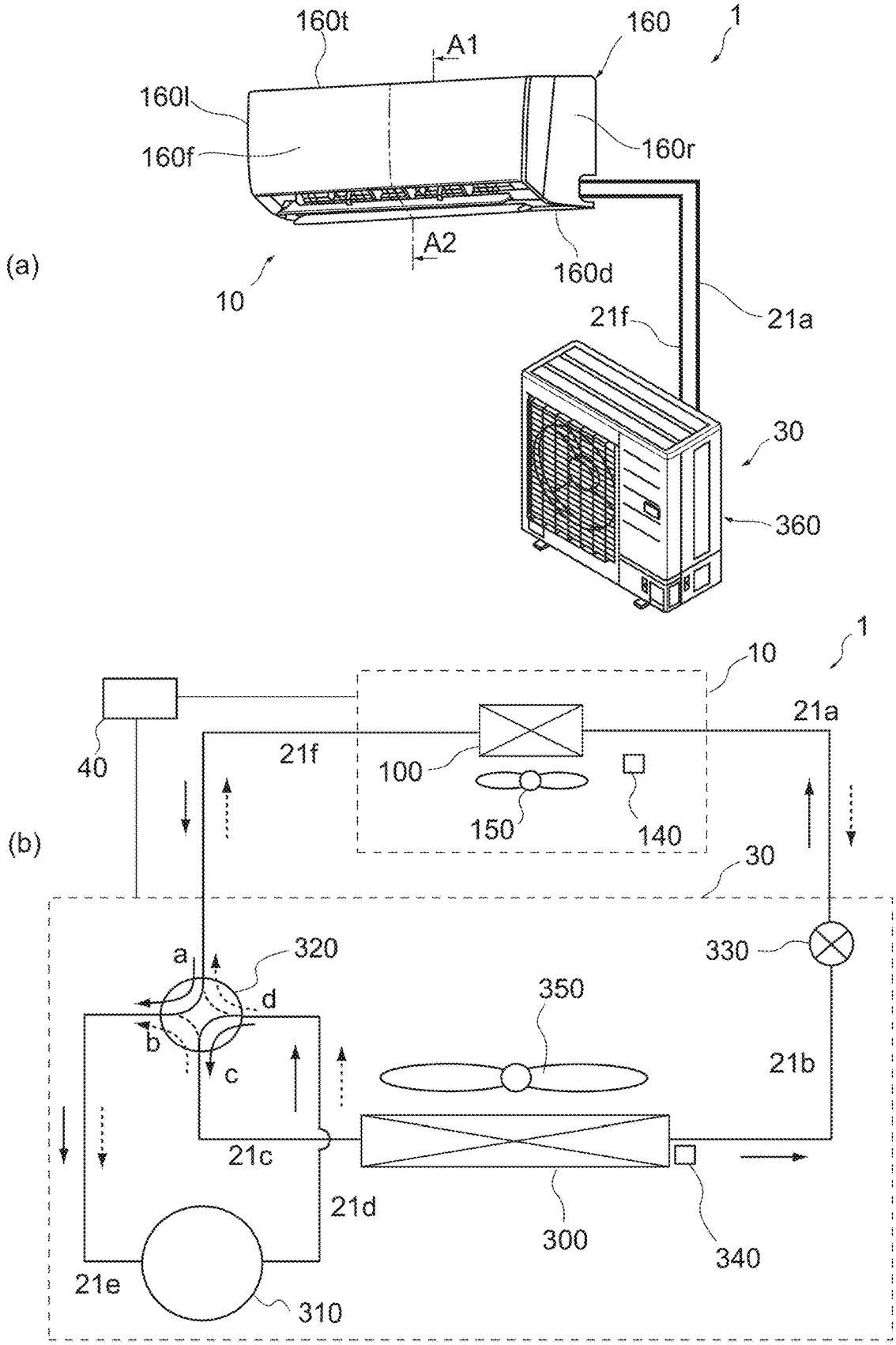
FIG. 1 Part (a) of FIG. 1 is a schematic perspective view showing an overview of an air conditioner according to this embodiment. Part (b) of FIG. 1 is a schematic a block diagram showing an overview of a refrigerant circuit of the air conditioner according to this embodiment.

Part (a) of FIG. 1 is a schematic perspective view showing an overview of an air conditioner according to this embodiment. Part (b) of FIG. 1 is a schematic block diagram showing an overview of a refrigerant circuit of the air conditioner according to this embodiment. An example of the air conditioner according to this embodiment is shown in Parts (a) and (b) of FIG. 1, and the present invention is not limited to this example. In the following, "connection" means that a heat exchanger and a pressure reducing device, which are parts of a refrigerant circuit, are connected by a pipeline (pipe) shown by the solid line in Part (b) of FIG. 1 to form a refrigerant circuit.

As shown in Part (a) of FIG. 1, an air conditioner 1 includes an indoor unit 10 installed indoors and an outdoor unit 30 installed outdoors. The indoor unit 10 and the outdoor unit 30 are connected to each other via a pipe 21*a* and a pipe 21*f*. Further, as shown in Part (b) of FIG. 1, the air conditioner 1 includes a control device 40 in addition to the indoor unit 10 and the outdoor unit 30. The air conditioner 1 is an air conditioner that enables a cooling operation and a heating operation.

The indoor unit 10 includes an indoor heat exchanger 100, a temperature sensor 140, and an indoor fan 150. The indoor heat exchanger 100, the temperature sensor 140, and the indoor fan 150 are housed in a casing 160 of the indoor unit 10 shown in Part (a) of FIG. 1. The casing 160 includes a top plate 160*t*, a right side plate 160*r*, a left side plate 1601, a bottom plate 160*b*, and a front plate (front panel) 160*f*. Each of these plates are formed of, for example, a resin.

The indoor heat exchanger 100 shown in Part (b) of FIG. 1 is, for example, a heat exchanger that includes a plurality of metal fins and a plurality of heat transfer tubes. The temperature sensor 140 detects the temperature of air in the room to which the indoor unit 10 is attached. Examples of the temperature sensor 140 include a thermocouple and a thermistor. A flow divider and a plurality of pipes, which are not shown in Part (b) of FIG. 1, are disposed inside the indoor unit 10. Details of these will be described below.

The outdoor unit 30 includes an outdoor heat exchanger 300, a compressor 310, a four-way valve 320, a pressure reducing device 330, a temperature sensor 340, and an outdoor fan 350. The outdoor heat exchanger 300, the compressor 310, the four-way valve 320, the pressure reducing device 330, the temperature sensor 340, and the outdoor fan 350 are housed in a casing 360 of the outdoor unit 30 shown in Part (a) of FIG. 1.

The outdoor heat exchanger 300 shown in Part (b) of FIG. 1 includes, for example, a plurality of metal fins and a plurality of heat transfer tubes. The pressure reducing device 330 is, for example, an expansion valve.

The compressor 310 is connected between the indoor heat exchanger 100 and the outdoor heat exchanger 300. Further, the four-way valve 320 is connected between the indoor heat exchanger 100 and the compressor 310 and between the outdoor heat exchanger 300 and the compressor 310.

The outdoor heat exchanger 300 is connected between the four-way valve 320 and the pressure reducing device 330. The pressure reducing device 330 is connected between the outdoor heat exchanger 300 and the indoor heat exchanger 100. The four-way valve 320, the outdoor heat exchanger 300, and the pressure reducing device 330 are connecter in series. The outdoor fan 350 is disposed in the vicinity of the outdoor heat exchanger 300.

The temperature sensor 340 detects the temperature of the outdoor heat exchanger 300. Examples of the temperature sensor 340 include a thermocouple and a thermistor.

The control device 40 controls the indoor unit 10 and the outdoor unit 30. The control device 40 may be disposed in the outdoor unit 30. Alternatively, part of the control device 40 may be disposed in the outdoor unit 30 and the remaining part may be disposed in the indoor unit 10. Further, in this embodiment, the indoor heat exchanger 100 is referred to simply as a heat exchanger in some cases.

The pipe 21*a* connects the indoor heat exchanger 100 and the pressure reducing device 330 to each other. A pipe 21*b* connects the pressure reducing device 330 and the outdoor heat exchanger 300 to each other. A pipe 21*c* connects the outdoor heat exchanger 300 and the four-way valve 320 to each other. A pipe 21*d* connects the four-way valve 320 and the compressor 310 to each other. A pipe 21*e* connects the compressor 310 and the four-way valve 320 to each other. The pipe 21*f* connects the four-way valve 320 and the indoor heat exchanger 100 to each other.

(Operation of Refrigerant Circuit)

An operation of the air conditioner 1 according to this embodiment will be described with reference to Part (b) of FIG. 1. The air conditioner 1 performs a heating operation in which the indoor heat exchanger 100 functions as a condenser and the outdoor heat exchanger 300 functions as an evaporator, and a cooling operation in which the indoor heat exchanger 100 functions as an evaporator and the outdoor heat exchanger 300 functions as a condenser. The heating operation and the cooling operation are switched by the control device 40. Further, the air conditioner 1 is capable of performing a dehumidification operation in the same cooling cycle as that of the cooling operation.

(Heating Operation)

In the case where the air conditioner 1 performs a heating operation, a refrigerant circulates in the direction indicated by the broken line arrow. In the heating operation, the indoor heat exchanger 100 functions as a condenser, and the outdoor heat exchanger 300 functions as an evaporator.

In the state of the heating operation, for example, the four-way valve 320 is in the state indicated by the broken line, i.e., a port a and a port d of the four-way valve 320 communicate with each other and a port b and a port c of the four-way valve 320 communicate with each other. When the compressor 310 is driven, the high-temperature and high-pressure gas-phase refrigerant discharged from the compressor 310 flows into the four-way valve 320 through the pipe 21*d* and flows into the indoor unit 10 from the four-way valve 320 via the pipe 21*f*. The high-temperature and high-pressure gas-phase refrigerant flowed into the indoor unit 10 flows into the indoor heat exchanger 100, exchanges heat with the indoor air taken into the indoor unit 10 by rotation of the indoor fan 150, and is condensed to become a high-temperature and high-pressure liquid-phase refrigerant.

The high-temperature and high-pressure liquid-phase refrigerant flowed out from the indoor heat exchanger 100 into the pipe 21*a* flows into the outdoor unit 30. The high-temperature and high-pressure liquid-phase refrigerant flowed into the outdoor unit 30 is depressurized via the pressure reducing device 330 whose degree of opening corresponds to the heating capacity to become a low-temperature and low-pressure gas-liquid two-phase refrigerant, and flows into the outdoor heat exchanger 300 via the pipe 21*b*. The low-temperature and low-pressure gas-liquid two-phase refrigerant flowed into the outdoor heat exchanger 300 exchanges heat with the outside air taken into the outdoor unit 30 by rotation of the outdoor fan 350, and evaporates to become a low-temperature and low-pressure gas-phase refrigerant. The low-temperature and low-pressure gas-phase refrigerant flowed out from the outdoor heat exchanger 300 into the pipe 21*c* flows through the four-way valve 320, is inhaled into the compressor 310, and is compressed again.

(Cooling Operation and Dehumidification Operation)

In the case where the air conditioner 1 performs a cooling operation or a dehumidification operation, a refrigerant circulates in the direction indicated by the solid line arrow in the air conditioner 1. In the cooling operation, the outdoor heat exchanger 300 functions as a condenser and the indoor heat exchanger 100 functions as an evaporator.

In the state of the cooling operation, the four-way valve 320 is in the state indicated by the solid line, i.e., the port a and the port b of the four-way valve 320 communicate with each other, and the port c and the port d of the four-way valve 320 communicate with each other. When the compressor 310 is driven, the high-temperature and high-pressure gas-phase refrigerant discharged from the compressor 310 flows into the four-way valve 320 through the pipe 21*d*, and flows into the outdoor heat exchanger 300 from the four-way valve 320 through the pipe 21*c*. The high-temperature and high-pressure gas-phase refrigerant flowed into the outdoor heat exchanger 300 exchanges heat with the outside air taken into the outdoor unit 30 by rotation of the outdoor fan 350, and is condensed to become a high-temperature and high-pressure liquid-phase refrigerant. The high-temperature and high-pressure liquid-phase refrigerant flowed out from the outdoor heat exchanger 300 into the pipe 21*b* is depressurized when passing through the pressure reducing device 330 whose degree of opening corresponds to the cooling capacity required during a cooling operation or the dehumidification capacity required during a dehumidification operation to become a low-temperature and low-pressure gas-liquid two-phase refrigerant, and flows into the pipe 21*a*.

The low-temperature and low-pressure gas-liquid two-phase refrigerant flowed into the indoor unit 10 via the pipe 21*a* flows into the indoor heat exchanger 100, exchanges heat with the indoor air taken into the indoor unit 10 by rotation of the indoor fan 150, and evaporates to become a low-temperature and low-pressure gas-phase refrigerant. The low-temperature and low-pressure gas-phase refrigerant flowed out from the indoor heat exchanger 100 flows into the four-way valve 320 through the pipe 21*f*. The refrigerant flowed out from the four-way valve 320 is inhaled into the compressor 310 via the pipe 21*e* and is compressed again.

Figure 2:
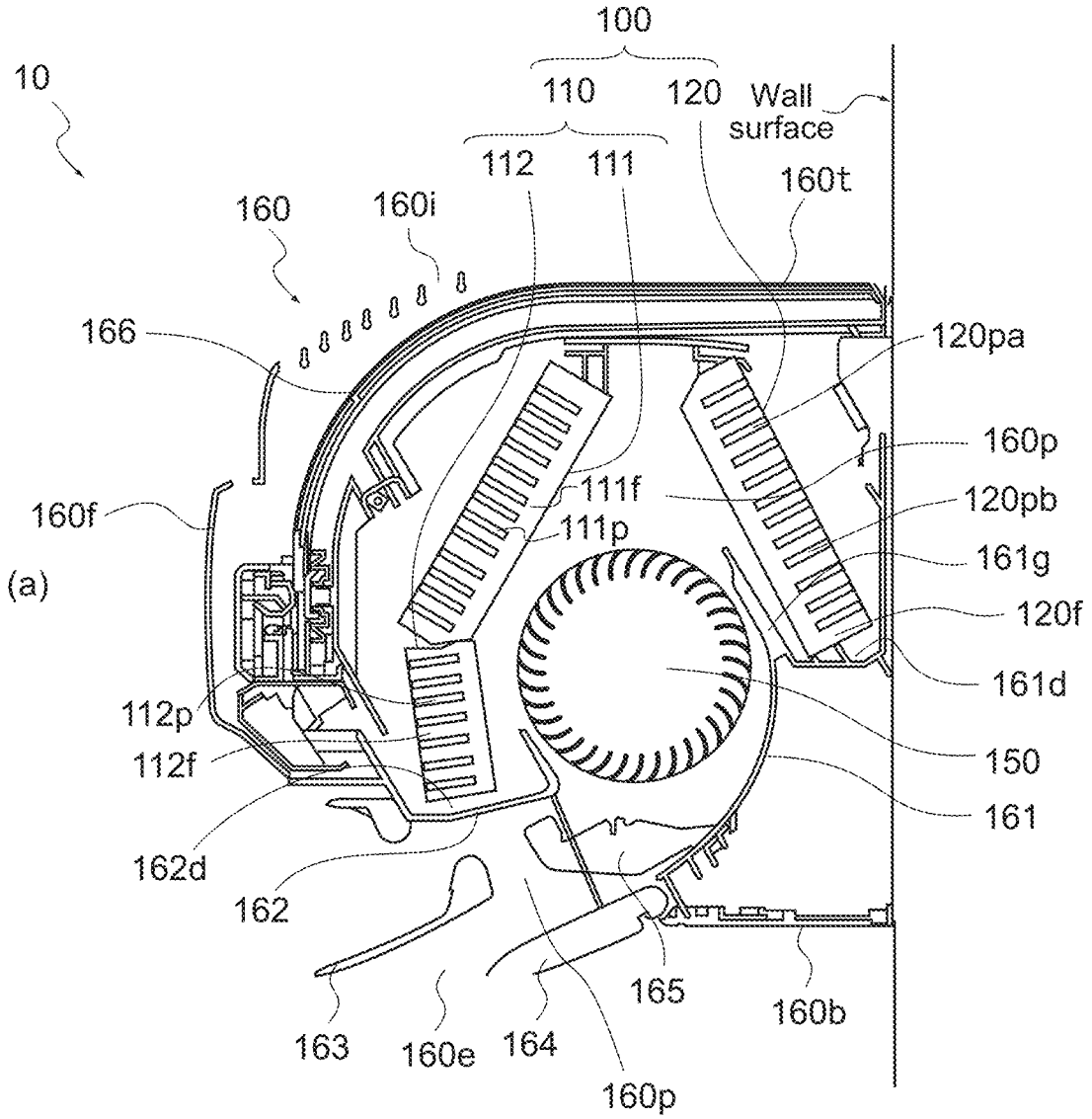
FIG. 2 Part (a) of FIG. 2 is an example of a schematic cross-sectional view of the indoor unit taken along the line A1-A2 in Part (a) of FIG. 1. Part (b) of FIG. 2 is a schematic cross-sectional view of a second heat exchange part 120 shown in Part (a) of FIG. 2 and the vicinity thereof.
Figure 2:
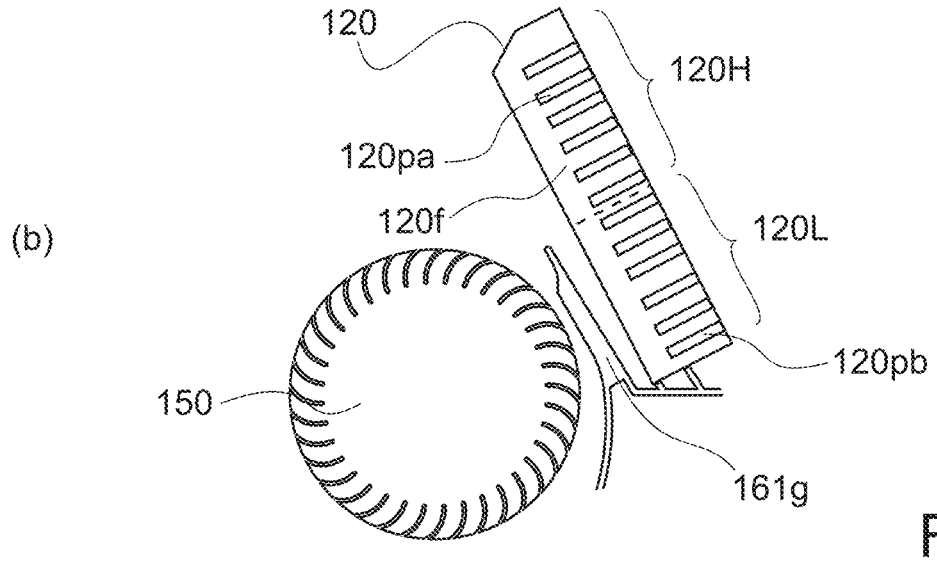

The cross-sectional structure of the indoor unit 10 will be described. Part (a) of FIG. 2 is an example of a schematic cross-sectional view of the indoor unit taken along the line A1-A2 in Part (a) of FIG. 1. Part (b) of FIG. 2 is a schematic cross-sectional view of a second heat exchange part 120 shown in Part (a) of FIG. 2 and the vicinity thereof. The indoor unit 10 is installed on, for example, a wall surface in the room.

The casing 160 included in the indoor unit 10 includes the top plate 160*t*, the right side plate 160*r*, the left side plate 1601, the bottom plate 160*b*, the front plate 160*f*, a base plate 161, and a frame plate 162. The base plate 161 is formed of, for example, a metal or a resin. The frame plate 162 is formed of, for example, a resin.

In the casing 160, the top plate 160*t* forms the top surface of the casing 160. An inlet port 160*i* through which the indoor air is inhaled into the indoor unit 10 is provided in the top plate 160*t*. The bottom plate 160*b* forms the bottom surface of the casing 160. The base plate 161 for attaching the indoor unit 10 to the wall surface is fixed to the bottom plate 160*b*. The front plate 160*f* is disposed to cover the front surface of the casing 160. Further, the frame plate 162 that surrounds the lower part of a lower heat exchange part 112 of a first heat exchange part 110 is provided below the front plate 160*f*.

An outlet port 160*e* that blows out the indoor air exchanged heat with the refrigerant in the indoor heat exchanger 100 into the room is provided below the frame plate 162. The outlet port 160*e* is formed by the space sandwiched between the base plate 161 and the frame plate 162. Further, the space connecting the inlet port 160*i* and the outlet port 160*e* is defined as an air passage 160*p*.

The indoor fan 150 is, for example, a cross-flow fan formed of a resin material and is rotatably supported in the air passage 160*p* between the indoor heat exchanger 100 and the outlet port 160*e*. The indoor fan 150 is disposed in the middle of the air passage 160*p*. The indoor fan 150 inhales the indoor air via the inlet port 160*i*. Then, the indoor fan 150 blows out the indoor air that passes through each of the first heat exchange part 110 and the second heat exchange part 120 via the outlet port 160*e*. For example, when the indoor fan 150 rotates, the indoor air is inhaled into the air passage 160*p* through the inlet port 160*i*, and the indoor air is blown out from the air passage 160*p* through the outlet port 160*e*.

The indoor heat exchanger 100 is disposed on the side of the top plate 160*t* and the side of the front plate 160*f* when viewed from the indoor fan 150. The indoor heat exchanger 100 includes the first heat exchange part 110 (first heat exchange part) and the second heat exchange part 120 (second heat exchange part). The first heat exchange part 110 further includes an upper heat exchange part 111 and the lower heat exchange part 112. The upper heat exchange part 111 includes a heat transfer tube 111*p* and a fin 111*f*. The lower heat exchange part 112 includes a heat transfer tube 112*p* and a fin 112*f*. The second heat exchange part 120 includes a heat transfer tube 120*pa*, a heat transfer tube 120*pb*, and a fin 120*f*.

The upper heat exchange part 111 of the first heat exchange part 110 and the second heat exchange part 120 are disposed above the indoor fan 150 in the air passage 160*p*, i.e., on the side of the top plate 160*t*. Part of the upper heat exchange part 111 and part of the second heat exchange part 120 face the indoor fan 150. The upper heat exchange part 111 of the first heat exchange part 110 and the second heat exchange part 120 are disposed in an inverted V shape with an acute angle in the cross section shown in Part (a) of FIG. 2.

The lower heat exchange part 112 of the first heat exchange part 110 is disposed in front of the indoor fan 150, i.e., on the side of the front plate 160*f*. The lower heat exchange part 112 faces the indoor fan 150. In the cross section shown in Part (a) of FIG. 2, the upper heat exchange part 111 and the lower heat exchange part 112 are disposed to intersect at an obtuse angle.

Each of the upper heat exchange part 111, the lower heat exchange part 112, and the second heat exchange part 120 is a microchannel type heat exchanger. For example, each of the upper heat exchange part 111, the lower heat exchange part 112, and the second heat exchange part 120 is formed by inserting a plurality of metal heat transfer tubes (flat tubes) into a plurality of metal fins. Further, each of the plurality of heat transfer tubes includes a minute flow path therein. Further, headers are connected to both ends of each of the plurality of heat transfer tubes (described below).

Further, the casing 160 includes a drain pan that collects condensed water flowing down from the first heat exchange part 110 or the second heat exchange part 120. For example, the surface of the frame plate 162 on the side of the lower heat exchange part 112 forms a drain pan 162*d* that receives condensed water generated in the first heat exchange part 110. Further, the surface of the base plate 161 on the side of the second heat exchange part 120 forms a drain pan 161*d* that receives condensed water generated in the second heat exchange part 120.

Further, the casing 160 includes a guide plate 161*g* that smoothly guides the indoor air passes through the indoor heat exchanger 100 to the outlet port 160*e*. For example, part of the base plate 161 extends between the indoor fan 150 and the second heat exchange part 120. This extending part is the guide plate 161*g*.

Further, the outlet port 160*e* is provided with an up-down air deflector 163 that deflects the direction of the indoor air blown out from the outlet port 160*e* in the up-and-down direction, and a diffuser 164. A right-left air deflector 165 that deflects the direction of the indoor air blown out from the outlet port 160*e* is provided on the upstream side of the outlet port 160*e* of the diffuser 164. Further, a filter 166 that removes dust contained in the indoor air taken into the indoor unit 10 is provided between the front plate 160*f* and the indoor heat exchanger 100.

In the indoor unit 10, when the indoor fan 150 rotates, the flow of the indoor air passing through the second heat exchange part 120 inside the indoor unit 10 is blocked by the guide plate 161*g*. As a result, as shown in Part (b) of FIG. 2, the second heat exchange part 120 has a high wind velocity region 120H where the wind velocity of the indoor air passing through the second heat exchange part 120 is relatively high and a low wind velocity region 120L where the wind velocity of the indoor air is relatively low. The high wind velocity region 120H is located above the low wind velocity region 120L in the direction of gravity. The low wind velocity region 120L is located closer to the drain pan 161*d* than the high wind velocity region 120H. The guide plate 161*g* is provided between the low wind velocity region 120L and the indoor fan 150.

In the case where the first heat exchange part 110 of the indoor heat exchanger 100 and the second heat exchange part 120 function as condensers, the indoor air exchanged heat with the refrigerant in each of the first heat exchange part 110 and the second heat exchange part 120 is blown out from the outlet port 160*e* into the room. As a result, the room in which the indoor unit 10 is installed is heated.

Figure 3:
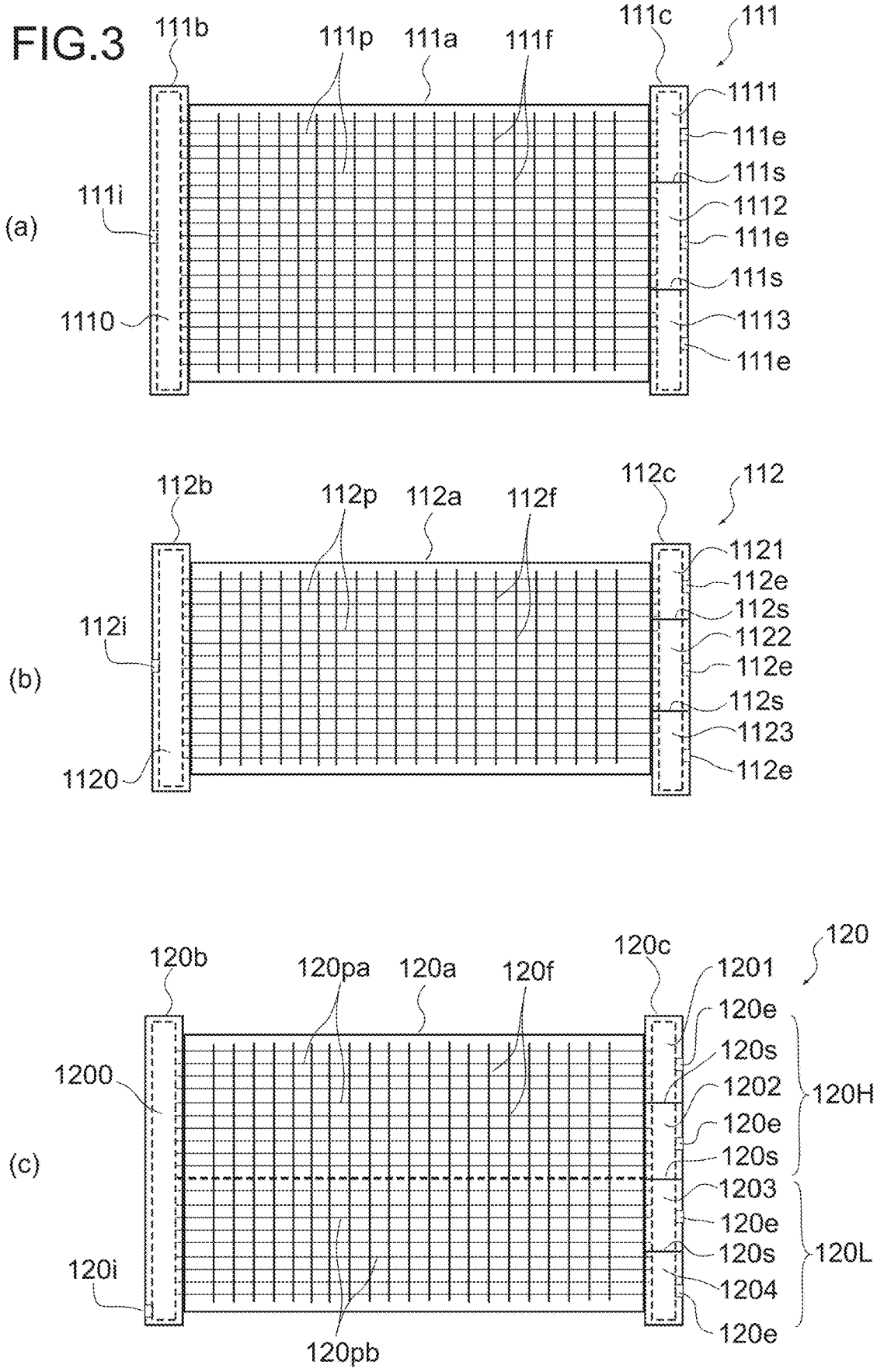
FIG. 3 is a schematic plan view of a heat exchange part according to this embodiment.

Part (a) of FIG. 3 to Part (c) of FIG. 3 are each a schematic plan view of the heat exchange part according to this embodiment. Part (a) of FIG. 3 shows the upper heat exchange part 111 in the first heat exchange part 110, Part (b) of FIG. 3 shows the lower heat exchange part 112 in the first heat exchange part 110. Part (c) of FIG. 3 shows the second heat exchange part 120. In this embodiment, for example, when using the indoor heat exchanger 100 as a condenser (during a heating operation), a refrigerant flows into the first heat exchange part 110, which is a pair of the upper heat exchange part 111 (Part (a) of FIG. 3) and the lower heat exchange part 112 (Part (b) of FIG. 3), and then the refrigerant flows into the second heat exchange part 120 (Part (c) of FIG. 3). That is, during a heating operation, the refrigerant flows through not a single heat exchanger but a plurality of heat exchange parts in a stepwise manner. Details of the flow of the refrigerant will be described with reference to the following FIG. 4.

The upper heat exchange part 111 shown in Part (a) of FIG. 3 includes a body portion 111*a*, and a header 111*b* and a header 111*c* that are disposed on both sides of the body portion 111*a* and connected to the body portion 111*a*.

The body portion 111*a* includes a plurality of fins 111*f* and at least one heat transfer tube 111*p* (e.g., a plurality of heat transfer tubes 111*p*). Each of the plurality of fins 111*f* is disposed between the header 111*b* and the header 111*c*. Each of the plurality of fins 111*f* extends in the longitudinal direction of each of the header 111*b* and the header 111*c*. Each of the plurality of heat transfer tubes 111*p* is disposed substantially orthogonal to the plurality of fins 111*f*. Each of the plurality of heat transfer tubes 111*p* is inserted through the plurality of fins 111*f*.

A pair of headers 111*b* and 111*c* are connected to both ends of the plurality of heat transfer tubes 111*p*. For example, the header 111*b* is connected to one end of each of the plurality of heat transfer tubes 111*p*. The header 111*c* is connected to the other end of each of the plurality of heat transfer tubes 111*p*.

In the upper heat exchange part 111, the header 111*b* has an internal space 1110 to which the plurality of heat transfer tubes 111*p* is commonly connected. Further, the header 111*c* disposed on the opposite side of the header 111*b* across the body portion 111*a* has internal spaces divided by, for example, at least one partition plate. For example, Part (a) of FIG. 3 shows an example in which the header 111*c* is divided into three internal spaces 1111, 1112, and 1113 by two partition plates 111*s*. The divided internal spaces 1111, 1112, and 1113 are lined up in the longitudinal direction of the header 111*c*.

Further, the header 111*b* is provided with an inflow port 111*i* that communicates with the internal space 1110 and through which a refrigerant flows in during a heating operation. The inflow port 111*i* serves as an outlet through which a refrigerant flows out during a cooling operation. Further, the header 111*c* is provided with an outflow port 111*e* that communicates with each of the internal spaces 1111, 1112, and 1113 and through which a refrigerant flows out during a heating operation. The outflow port 111*e* serves as an inflow port through which a refrigerant flows in during a cooling operation.

When using the indoor heat exchanger 100 as a condenser (during a heating operation), a refrigerant flows into the upper heat exchange part 111 from the header 111*b*, and the refrigerant flows out of the upper heat exchange part 111 via the header 111*c*.

The lower heat exchange part 112 shown in Part (b) of FIG. 3 includes a body portion 112*a*, and a header 112*b* and a header 112*c* that are disposed on both sides of the body portion 112*a* and connected to the body portion 112*a*.

The body portion 112*a* includes a plurality of fins 112*f* and at least one heat transfer tube 112*p* (e.g., a plurality of heat transfer tubes 112*p*). Each of the plurality of fins 112*f* is disposed between the header 112*b* and the header 112*c*. Each of the plurality of fins 112*f* extends in the longitudinal direction of each of the header 112*b* and the header 112*c*. Each of the plurality of heat transfer tubes 112*p* is disposed substantially orthogonal to the plurality of fins 112*f*. Each of the plurality of heat transfer tubes 112*p* is inserted into the plurality of fins 112*f*.

A pair of headers 112*b* and 112*c* are connected to both ends of the plurality of heat transfer tubes 112*p*. For example, one end of each of the plurality of heat transfer tubes 112*p* is connected to the header 112*b*. The other end of each of the plurality of heat transfer tubes 112*p* is connected to the header 112*c*.

In the lower heat exchange part 112, the header 112*b* has an internal space 1120 to which the plurality of heat transfer tubes 112*p* is commonly connected. Further, the header 112*c* disposed on the opposite side of the header 112*b* across the body portion 112*a* has an internal space divided by, for example, at least one partition plate. For example, Part (b) of FIG. 3 shows an example in which the header 112*c* is divided into three internal spaces 1121, 1122, and 1123 by two partition plates 112*s*. The divided internal spaces 1121, 1122, and 1123 are lined up in the longitudinal direction of the header 112*c*.

Further, the header 112*b* is provided with an inflow port 112*i* that communicates with the internal space 1120 and through which a refrigerant flows in during a heating operation. The inflow port 112*i* serves as an outflow port through which a refrigerant flows out during a cooling operation. Further, the header 112*c* is provided with an outflow port 112*e* that communicates with each of the internal spaces 1121, 1122, and 1123 and through which a refrigerant flows out during a heating operation. The outflow port 112*e* serves as an inflow port through which a refrigerant flows in during a cooling operation.

When using the indoor heat exchanger 100 as a condenser (during a heating operation), a refrigerant flows into the lower heat exchange part 112 from the header 112*b*, and the refrigerant flows out of the lower heat exchange part 112 via the header 112*c*.

Note that in this embodiment, the header 111*c* or the header 112*c* is used as a second header, and each of the internal spaces 1111, 1112, and 1113 or each of the internal spaces 1121, 1122, and 1123 is used as a second internal space.

The second heat exchange part 120 shown in Part (c) of FIG. 3 includes a body portion 120*a*, and a header 120*b* (first header) and a header 120*c* that are disposed on both sides of the body portion 120*a* and connected to the body portion 120*a*.

The body portion 120*a* includes a plurality of fins 120*f*, at least one heat transfer tube 120*pa* (first heat transfer tube), and at least one heat transfer tube 120*pb* (second heat transfer tube). Each of the plurality of fins 120*f* is disposed between the header 120*b* and the header 120*c* and extends in the longitudinal direction of each of the header 120*b* and the header 120*c*. The at least one heat transfer tube 120*pa* (e.g., a plurality of heat transfer tubes 120*pa*) is disposed in the high wind velocity region 120H of the second heat exchange part 120. The at least one heat transfer tube 120*pb* (e.g., a plurality of heat transfer tubes 120*pb*) is disposed in the low wind velocity region 120L of the second heat exchange part 120. Each of the plurality of heat transfer tubes 120*pa* and each of the plurality of heat transfer tubes 120*pb* are disposed substantially orthogonal to the plurality of fins 120*f*. Each of the plurality of heat transfer tubes 120*pb* is inserted into the plurality of fins 120*f*.

A pair of headers 120*b* and 120*c* are connected to both ends of the plurality of heat transfer tubes 120*pa* and both ends of the plurality of heat transfer tubes 120*pb*. For example, the header 120*b* is connected to one end of each of the plurality of heat transfer tubes 120*pa* and one end of each of the plurality of heat transfer tubes 120*pb*. The header 120*c* is connected to the other end of each of the plurality of heat transfer tubes 120*pa* and the other end of each of the plurality of heat transfer tubes 120*pb*.

In the second heat exchange part 120, the header 120*b* has an internal space 1200 (first internal space) to which the plurality of heat transfer tubes 120*pa* and the plurality of heat transfer tubes 120*pb* are commonly connected. The volume of the internal space 1200 is larger than the volume of each of the internal spaces 1111, 1112, and 1113 or than the volume of each of the internal spaces 1121, 1122, and 1123. In the case where the volume is large, the flow velocity of the gas-liquid two-phase refrigerant flowed into the internal space 1200 decreases, and two-phase separation easily occurs in the internal space 1200.

Further, the header 120*c* disposed on the opposite side of the header 120*b* across the body portion 120*a* has, for example, an internal space divided into a plurality of spaces. For example, Part (c) of FIG. 3 shows an example in which the header 120*c* is divided into four internal spaces 1201, 1202, 1203, and 1204 by three partition plates 120*s*. The divided internal spaces 1201, 1202, 1203, and 1204 are lined up in the longitudinal direction of the header 120*c*.

Further, the header 120*b* is provided with an inflow port 120*i* that communicates with the internal space 1200 and through which a refrigerant flows in during a heating operation. For example, during a heating operation, the refrigerant flowed out from the first heat exchange part 110 flows into the inflow port 120*i*. The inflow port 120*i* serves as an outflow port through which a refrigerant flows out during a cooling operation. The inflow port 120*i* is disposed in the lower part of the header 120*b* in the direction of gravity. For example, the inflow port 120*i* is disposed in the low wind velocity region 120L at a position furthest from the high wind velocity region 120H in the longitudinal direction of the header 120*b*.

Further, the header 120*c* is provided with an outflow port 120*e* that communicates with each of the internal spaces 1201, 1202, 1203, and 1204 and through which a refrigerant flows out during a heating operation. The outflow port 120*e* serves as an inflow port through which a refrigerant flows in during a cooling operation.

When using the indoor heat exchanger 100 as a condenser (during a heating operation), the refrigerant flowed out from the first heat exchange part 110 flows into the internal space 1200 of the header 120*b*. After that, the refrigerant flowed into the internal space 1200 flows into each of the heat transfer tube 120*pa* and the heat transfer tube 120*pb* from the internal space 1200. Further, the refrigerant flows out of the second heat exchange part 120 via the header 120*c*.

Figure 4:
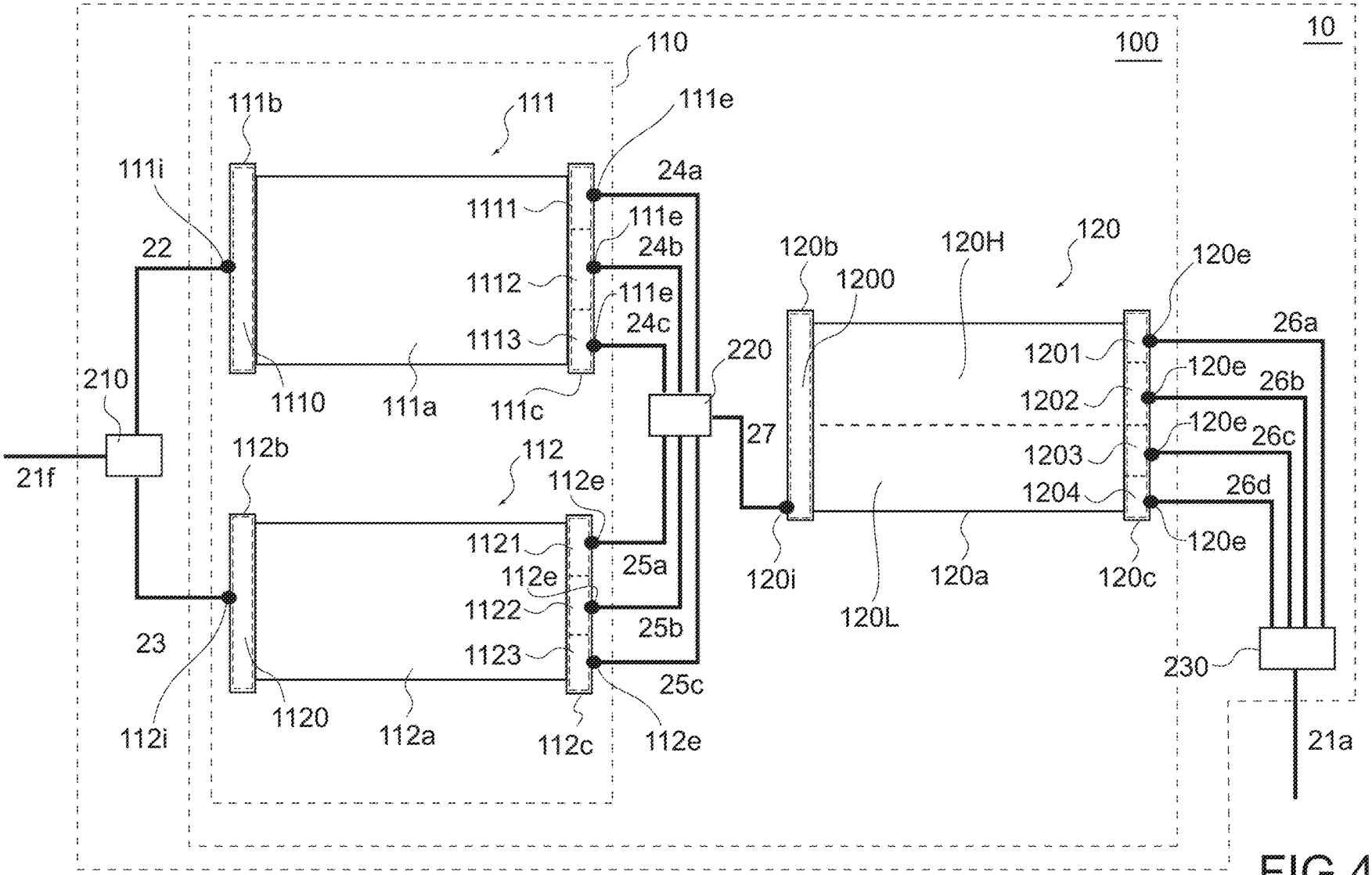
FIG. 4 is a schematic block diagram showing how each of an upper heat exchange part 111 and a lower heat exchange part 112 and the second heat exchange part 120 are connected by pipes in an indoor heat exchanger.

FIG. 4 is a schematic block diagram showing how each of the upper heat exchange part 111 and the lower heat exchange part 112 and the second heat exchange part 120 are connected by pipes in the indoor heat exchanger. Here, the state of a heating operation (the indoor heat exchanger 100 is used as a condenser) is when a refrigerant flows from the side of the pipe 21*f* to the side of the pipe 21*a*, and the state of a cooling operation (the indoor heat exchanger 100 is used as an evaporator) is when a refrigerant flows from the side of the pipe 21*a* to the side of the pipe 21*f*.

As shown in FIG. 4, the indoor unit 10 includes a flow divider 210, a flow divider 220, a flow divider 230, a pipe 22, a pipe 23, pipes 24*a*, 24*b*, and 24*c*, pipes 25*a*, 25*b*, and 25*c*, pipes 26*a*, 26*b*, 26*c*, and 26*d*, and a pipe 27 in addition to the indoor heat exchanger 100 and the indoor fan 150.

As shown in FIG. 4, the pipe 21*f* is branched into the pipe 22 and the pipe 23 by the flow divider 210 just before the first heat exchange part 110. One pipe 22 branched from the flow divider 210 connects the flow divider 210 to the inflow port 111*i* provided in the header 111*b* of the upper heat exchange part 111. The other pipe 23 branched from the flow divider 210 connects the flow divider 210 to the inflow port 112*i* provided in the header 112*b* of the lower heat exchange part 112.

For example, a plurality of pipes 24*a*, 24*b*, and 24*c* is connected to the header 111*c* provided on the opposite side of the header 111*b*. The pipe 24*a* connects the outflow port 111*e* connected to an internal space 1111 to the flow divider 220. The pipe 24*b* connects the outflow port 111*e* connected to an internal space 1112 to the flow divider 220. The pipe 24*c* connects the outflow port 111*e* connected to an internal space 1113 to the flow divider 220. The pipe 24*a*, the pipe 24*b*, and the pipe 24*c* connected to the header 111*c* are disposed to merge into the flow divider 220.

Further, for example, a plurality of pipes 25*a*, 25*b*, and 25*c* is connected to the header 112*c* of the lower heat exchange part 112. The pipe 25*a* connects the outflow port 112*e* connected to an internal space 1121 to the flow divider 220. The pipe 25*b* connects the outflow port 112*e* connected to an internal space 1122 to the flow divider 220. The pipe 25*c* connects the outflow port 112*e* connected to an internal space 1123 to the flow divider 220. The pipe 25*a*, the pipe 25*b*, and the pipe 25*c* connected to the header 112*c* are disposed to merge into the flow divider 220.

The flow divider 220 and the header 120*b* of the second heat exchange part 120 are connected by the pipe 27. As a result, the internal space 1111 is connected to the internal space 1200 via the pipe 24*a*, the flow divider 220, and the pipe 27, the internal space 1112 is connected to the internal space 1200 via the pipe 24*b*, the flow divider 220, and the pipe 27, and the internal space 1113 is connected to the internal space 1200 via the pipe 24*c*, the flow divider 220, and the pipe 27. Further, the internal space 1121 is connected to the internal space 1200 via the pipe 25*a*, the flow divider 220, and the pipe 27, the internal space 1122 is connected to the internal space 1200 via the pipe 25*b*, the flow divider 220, and the pipe 27, and the internal space 1123 is connected to the internal space 1200 via the pipe 25*c*, the flow divider 220, and the pipe 27.

Further, for example, a plurality of pipes 26*a*, 26*b*, 26*c*, and 26*d* is connected to the header 120*c* provided on the opposite side of the header 120*b*. The pipe 26*a* connects the outflow port 120*e* connected to an internal space 1201 to the flow divider 230. The pipe 26*b* connects the outflow port 120*e* connected to an internal space 1202 to the flow divider 230. The pipe 26*c* connects the outflow port 120*e* connected to an internal space 1203 to the flow divider 230. The pipe 26*d* connects the outflow port 120*e* connected to an internal space 1204 to the flow divider 230. The pipe 26*a*, the pipe 26*b*, the pipe 26*c*, and the pipe 26*d* connected to the header 120*c* are disposed to merge into the flow divider 230. Further, the pipe 21*a* is connected to the flow divider 230.

The flow of a refrigerant in the indoor unit 10 will be described using an example of a heating operation.

During a heating operation, a refrigerant flows from the pipe 21*f* to the pipe 21*a*, and the indoor heat exchanger 100 disposed between the pipe 21*f* and the pipe 21*a* functions as a condenser. During a heating operation, a gas-phase refrigerant flows into the indoor heat exchanger 100 from the pipe 21*f*. After that, the refrigerant flowing through the indoor heat exchanger 100 and the indoor air taken into the indoor unit 10 exchange heat with each other, and the refrigerant is condensed in the indoor heat exchanger 100 to become a two-phase gas-liquid state and then liquefy. After that, the liquid-phase refrigerant flows out from the indoor heat exchanger 100 into the pipe 21*a*. The flow of a refrigerant in FIG. 4 will be described below with the refrigerant in the gas phase as a gas-phase refrigerant, the refrigerant in the gas-liquid two-phase as a gas-liquid two-phase refrigerant, and the refrigerant in the liquid phase as a liquid-phase refrigerant.

For example, the gas-phase refrigerant flowing through the pipe 21*f* is divided into the pipe 22 and the pipe 23 by the flow divider 210.

Next, the gas-phase refrigerant flowing through the pipe 22 flows into the header 111*b* of the upper heat exchange part 111. Since the refrigerant in the gas phase flows into the internal space 1110 of the header 111*b*, the gas-phase refrigerant is uniformly dispersed in the internal space 1110 without being affected by gravity. That is, in the internal space 1110 into which a gas-phase refrigerant flows, even if the internal space 1110 is not divided by a partition plate, it is possible to allow a refrigerant to uniformly flow into the plurality of heat transfer tubes 111*p* connected to the internal space 1110.

Next, the gas-phase refrigerant and the indoor air exchange heat with each other in the body portion 111*a* of the upper heat exchange part 111, and part of the gas-phase refrigerant is condensed in the body portion 111*a* to become a gas-liquid two-phase refrigerant. After that, the gas-liquid two-phase refrigerant formed in the body portion 111*a* flows into each of the internal spaces 1111, 1112, and 1113 of the header 111*c*.

The gas-liquid two-phase refrigerants flowed into the internal spaces 1111, 1112, and 1113 join together at the flow divider 220 and flow through the pipe 27. The gas-liquid two-phase refrigerant flowing through the pipe 27 flows into the header 120*b* of the second heat exchange part 120.

Meanwhile, the gas-phase refrigerant flowing through the pipe 23 flows into the header 112*b* of the lower heat exchange part 112. Since the refrigerant in the gas phase flows into the internal space 1120 of the header 112*b*, the gas-phase refrigerant is uniformly dispersed in the internal space 1120.

Next, the gas-phase refrigerant and the indoor air exchange heat with each other in the body portion 112*a* of the lower heat exchange part 112, and part of the gas-phase refrigerant is condensed in the body portion 112*a* to become a gas-liquid two-phase refrigerant. After that, the gas-liquid two-phase refrigerant formed in the body portion 112*a* flows into each of the internal spaces 1121, 1122, and 1123 of the header 112*c*.

The gas-liquid two-phase refrigerant flowed into the internal spaces 1121, 1122, and 1123 join together at the flow divider 220 and flow through the pipe 27. The gas-liquid two-phase refrigerant flowing through the pipe 27 flows into the header 120*b* of the second heat exchange part 120.

In this way, the gas-phase refrigerant before flowing into the first heat exchange part 110 (the upper heat exchange part 111, the lower heat exchange part 112) becomes a gas-liquid two-phase refrigerant in the first heat exchange part 110, and this gas-liquid two-phase refrigerant flows into the header 120*b* of the second heat exchange part 120. The subsequent flow of the refrigerant will be described with reference to Parts (a) and (b) of FIG. 5.

Figure 5:
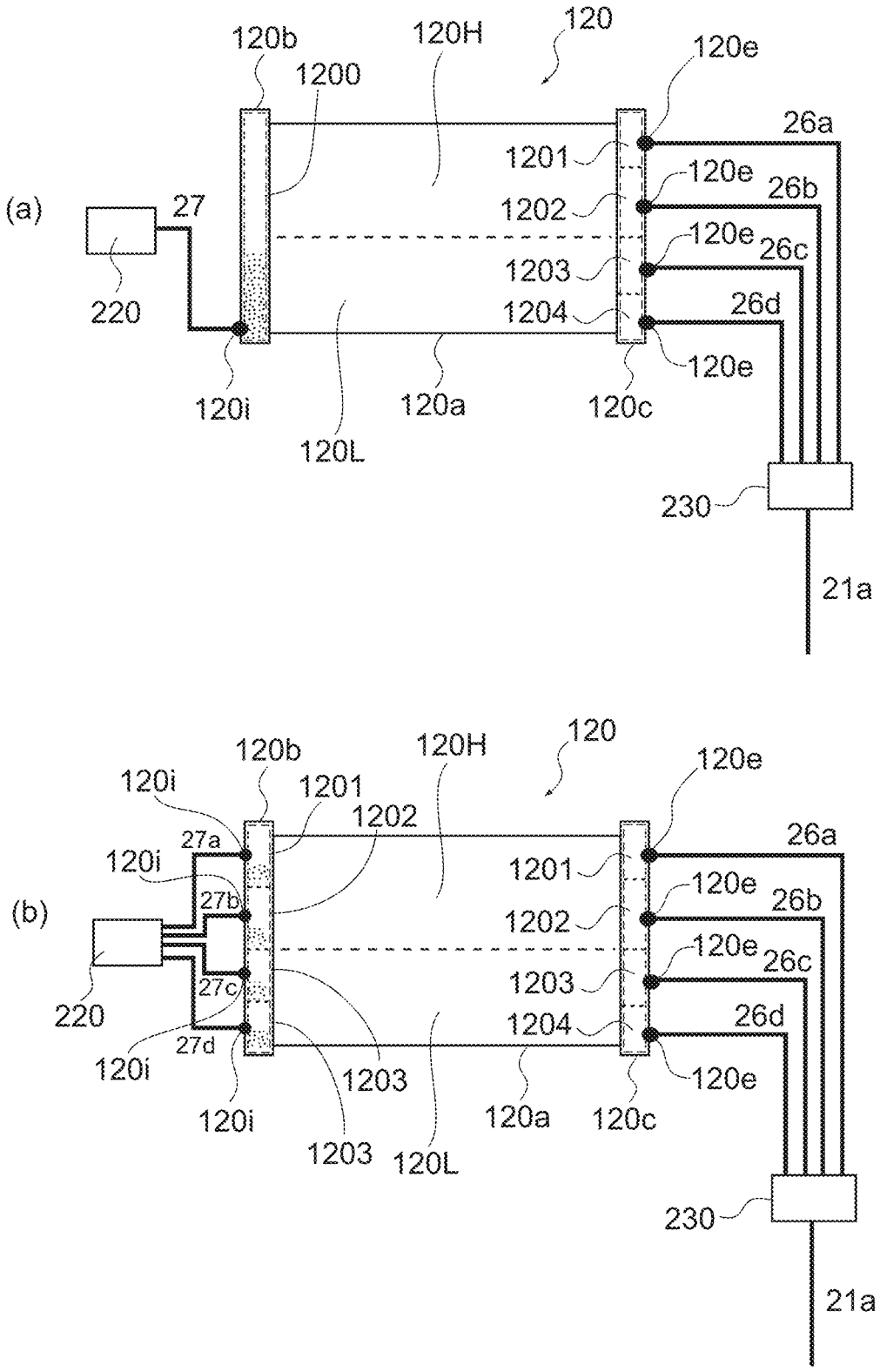
FIG. 5 Part (a) of FIG. 5 is a schematic block diagram describing a flow of a refrigerant according to this embodiment. Part (b) of FIG. 5 is a schematic block diagram describing a flow of a refrigerant according to Comparative Example.

Part (a) of FIG. 5 is a schematic block diagram describing the flow of a refrigerant according to this embodiment. Part (b) of FIG. 5 is a schematic block diagram describing the flow of a refrigerant according to Comparative Example.

As shown in Part (a) of FIG. 5, the gas-liquid two-phase refrigerant flowed into the header 120*b* of the second heat exchange part 120 is influenced by gravity to be separated into a liquid-phase refrigerant and a gas-phase refrigerant in the internal space 1200. For example, a liquid-phase refrigerant with high density (dotted part in the figure) accumulates in the lower part of the internal space 1200, while the upper part of the internal space 1200 is filled with a gas-phase refrigerant with low density.

As a result, a refrigerant with a relatively low degree of dryness mainly flows through the heat transfer tube provided in the low wind velocity region 120L, and a refrigerant with a relatively high degree of dryness mainly flows through the heat transfer tube provided in the high wind velocity region 120H. Here, the refrigerant with a high degree of dryness releases more latent heat than the refrigerant with a low degree of dryness and is condensed. Therefore, the high-speed indoor air which flow through the high wind velocity region 120H and the refrigerant with a high degree of dryness exchange heat with each other, the low-speed indoor air which flow through the low wind velocity region 120L and the refrigerant with a low degree of dryness exchange heat with each other, and thus, the amount of heat exchange (the amount of heat released from the second heat exchange part 120 to the indoor air or the amount of heat absorbed by the indoor air from the second heat exchange part 120) of the entire second heat exchange part 120 including the high wind velocity region 120H and the low wind velocity region 120L increases. That is, the amount of indoor air passing through the body portion 120*a* is greater in the high wind velocity region 120H than the low wind velocity region 120L. For this reason, when the refrigerant with a high degree of dryness, which releases more latent heat and is condensed, passes through the high wind velocity region 120H, heat release to the indoor air increases and the amount of heat exchange in the high wind velocity region 120H increases. As a result, the amount of heat exchange of the entire second heat exchange part 120 increases.

Conversely, if the high-speed indoor air which flow through the high wind velocity region 120H and the refrigerant with a low degree of dryness exchange heat with each other and the low-speed indoor air which flow through the low wind velocity region 120L and the refrigerant with a high degree of dryness exchange heat with each other, the refrigerant with a high degree of dryness, which releases more latent heat, passes through the low wind velocity region 120L and the amount of heat exchange of the entire second heat exchange part 120 does not increase.

Here, as shown in Comparative Example shown in Part (b) of FIG. 5, when a plurality of pipes 27*a*, 27*b*, 27*c*, and 27*d* is branched from the flow divider 220 and the header 120*b* of the second heat exchange part 120 is divided into a plurality of internal spaces 1201, 1202, 1203, and 1204 using partition plates, the gas-liquid two-phase refrigerant flowed into the flow divider 220 is evenly divided into the internal space 1201 via the pipe 27*a*, the internal space 1202 via the pipe 27*b*, the internal space 1203 via the pipe 27*c*, and the internal space 1204 via the pipe 27*d*, respectively.

Therefore, a gas-liquid two-phase refrigerant with the same degree of dryness flows through both the high wind velocity region 120H and the low wind velocity region 120L, and thus, the refrigerant with a high degree of dryness, which releases more latent heat and is condensed, cannot be caused to flow through the high wind velocity region 120H. As a result, the amount of heat exchange of the entire second heat exchange part 120 does not increase.

Further, there is also a method of changing the volumes of the internal space 1201, the internal space 1202, the internal space 1203, and the internal space 1204 depending on the wind velocity distribution of the indoor air passing through the second heat exchange part 120, generating a flow velocity difference by changing the number of heat transfer tubes 120*pa* to be connected, and increasing the amount of heat exchange by increasing the circulation amount of the refrigerant in the high wind velocity region 120H. However, in the region where the number of heat transfer tubes 120*pa* to be connected is reduced, the pressure loss in the refrigerant flow path increases as the flow velocity of the refrigerant increases. As a result, in the region where the cross-sectional area of the flow path is small, the amount of heat exchange decreases. On the other hand, in this embodiment, it is possible to suppress the increase in pressure loss in the refrigerant flow path without dividing the internal space 1200 into a plurality of internal spaces.

After that, in this embodiment, the liquid-phase refrigerant formed by heat exchange between the gas-phase refrigerant and the high-speed indoor air mainly accumulates in the internal spaces 1201 and 1202 of the header 120*c*, and the liquid-phase refrigerant formed by heat exchange between the liquid-phase refrigerant and the low-speed indoor air mainly accumulates in the internal spaces 1203 and 1204 of the header 120*c*. Further, the liquid-phase refrigerant flowed into the pipe 26*a* from the internal space 1201, the liquid-phase refrigerant flowed into the pipe 26*b* from the internal space 1202, the liquid-phase refrigerant flowed into the pipe 26*c* from the internal space 1203, and the liquid-phase refrigerant flowed into the pipe 26*d* from the internal space 1204 join together at the flow divider 230. Then, the refrigerant joined together at the flow divider 230 flows through the pipe 21*a* as a liquid-phase refrigerant.

Further, in this embodiment, the indoor heat exchanger 100 is not an integrated heat exchanger, but is divided into the first heat exchange part 110 and the second heat exchange part 120. As a result, during a heating operation, the gas-phase refrigerant is condensed by the first heat exchange part 110 to become a gas-liquid two-phase refrigerant, and the gas-liquid two-phase refrigerant is condensed by the second heat exchange part 120 to become a liquid-phase refrigerant. Here, if the first heat exchange part 110 is not provided, the gas-phase refrigerant flows into the header 120*b* of the second heat exchange part 120. For this reason, a refrigerant cannot be separated into a liquid-phase refrigerant and a gas-phase refrigerant by gravity in the internal space 1200, and the function of the second heat exchange part 120 having the internal space 1200 cannot be exhibited.

Further, in this embodiment, the inflow port 120*i* into which the gas-liquid two-phase refrigerant flows is disposed in the lower part of the header 120*b* in the direction of gravity. Here, if the inflow port 120*i* is disposed in the upper part of the header 120*b* in the direction of gravity, there is a possibility that a gas-liquid two-phase refrigerant with a low degree of dryness enters the heat transfer tube disposed in the high wind velocity region 120H and the amount of heat exchange of the high wind velocity region 120H decreases. On the other hand, in this embodiment, since the inflow port 120*i* is disposed in the lower part of the header 120*b* in the direction of gravity, the liquid-phase refrigerant accumulates in the lower part of the internal space 1200 and the gas-phase refrigerant accumulates in the upper part of the internal space 1200.

As described above, in accordance with this embodiment, the decrease in the amount of heat exchange between a refrigerant and air due to pressure loss is suppressed.

Further, in this embodiment, when stitching from a heating operation to a cooling operation, the liquid-phase refrigerant flowed into the flow divider 230 from the pipe 21*a* is divided into the pipes 26*a*, 26*b*, 26*c*, and 26*d*, respectively. After that, the liquid-phase refrigerant flowed into the internal space 1201 from the pipe 26*a*, the liquid-phase refrigerant flowed into the internal space 1202 from the pipe 26*b*, the liquid-phase refrigerant flowed into the internal space 1203 from the pipe 26*c*, and the liquid-phase refrigerant flowed into the internal space 1204 from the pipe 26*d* become a gas-liquid two-phase refrigerant by heat exchange with the indoor air in the body portion 120*a*, and flow into the internal space 1200 of the header 120*b*.

Next, in a cooling operation, the gas-liquid two-phase refrigerant flowed into the internal space 1200 is divided into the pipes 24*a*, 24*b*, 24*c*, 25*a*, 25*b*, and 25*c* by the flow divider 220 via the pipe 27. After that, the gas-liquid two-phase refrigerant flowed into the internal space 1111 exchanges heat with the indoor air in the body portion 111*a* to become a gas-phase refrigerant, and flows into the internal space 1110 of the header 111*b*. The gas-liquid two-phase refrigerant flowed into the internal space 1112 exchanges heat with the indoor air in the body portion 111*a* to become a gas-phase refrigerant, and flows into the internal space 1110 of the header 111*b*. The gas-liquid two-phase refrigerant flowed into the internal space 1113 exchanges heat with the indoor air in the body portion 111*a* to become a gas-phase refrigerant, and flows into the internal space 1110 of the header 111*b*. Meanwhile, the gas-liquid two-phase refrigerant flowed into the internal space 1121 exchanges heat with the indoor air in the body portion 112*a* to become a gas-phase refrigerant, and flows into the internal space 1120 of the header 112*b*. The gas-liquid two-phase refrigerant flowed into the internal space 1122 exchanges heat with the indoor air in the body portion 112*a* to become a gas-phase refrigerant, and flows into the internal space 1120 of the header 112*b*. The gas-liquid two-phase refrigerant flowed into the internal space 1123 exchanges heat with the indoor air in the body portion 112*a* to become a gas-phase refrigerant, and flows into the internal space 1120 of the header 112*b*.

In the cooling operation, after that, the gas-phase refrigerant in the header 111*b* flows into the flow divider 210 through the pipe 22, and the gas-phase refrigerant in the header 112*b* flows into the flow divider 210 through the pipe 23. After that, the gas-phase refrigerant flows through the pipe 21*f*.

In this way, in the case of using the indoor heat exchanger 100 as an evaporator, the gas-liquid two-phase refrigerant accumulated in the header 120*b* is appropriately diverted by the flow divider 220 into the upper heat exchange part 111 and also into the lower heat exchange part 112.

Further, in this embodiment, it is not necessary to divide the header 120*b* of the second heat exchange part 120 as in Comparative Example (Part (b) of FIG. 5). As a result, it is possible to suppress the increase in cost by the amount for not dividing the header 120*b* of the second heat exchange part 120.

Although an embodiment of the present invention has been described, it goes without saying that the present invention is not limited to the above-mentioned embodiment and various modifications can be made. For example, a means for dividing the refrigerant in the header 111*c* or the header 112*c* without using the flow divider 220 may be provided, or a means for dividing the refrigerant in the header 120*c* without using the flow divider 230 may be provided. Each embodiment is not necessarily an independent form, and can be combined as far as technologically possible.

REFERENCE SIGNS LIST

1 air conditioner
10 indoor unit
21*a*, 21*b*, 21*c*, 21*d*, 21*e*, 21*f*, 22, 23, 24*a*, 24*b*, 24*c*, 25*a*, 25*b*, 25*c*, 26*a*, 26*b*, 26*c*, 26*d*, 27 pipe
30 outdoor unit
40 control device
100 indoor heat exchanger
110, 120 heat exchange part
111 upper heat exchange part
112 lower heat exchange part
111*a*, 112*a*, 120*a* body portion
111*b*, 111*c*, 112*b*, 112*c*, 120*b*, 120*c* header
111*e*, 112*e*, 120*e* outflow port
111*f*, 112*f*, 120*f* fin
1111, 112*i*, 120*i* inflow port
111*s*, 112*s*, 120*s* partition plate

111*p*, 112*p*, 120*p* heat transfer tube
120H high wind velocity region
120L low wind velocity region
140 temperature sensor
150 indoor fan
160, 360 casing
160*t* top plate
160*b* bottom plate
1601 left side plate
160*r* right side plate
160*f* front plate
160*i* inlet port
160*p* air passage
160*e* outlet port
161 base plate
161*d* drain pan
161*g* guide plate
162 frame plate
162*d* drain pan
163 up-down air deflector
164 diffuser
165 right-left air deflector
166 filter
210, 220, 230 flow divider
300 outdoor heat exchanger
310 compressor
320 four-way valve
330 pressure reducing device
340 temperature sensor
350 outdoor fan
110, 1111, 1112, 1113, 1120, 1121, 1122, 1123, 1200, 1201, 1202, 1203, 1204 internal space

The invention claimed is:

1. An indoor unit of an air conditioner, comprising:

a heat exchanger that includes a first heat exchange part and a second heat exchange part, wherein the second heat exchange part has a high wind velocity region where a wind velocity of air passing through the second heat exchange part is relatively high and a low wind velocity region where the wind velocity of air is relatively low, and the high wind velocity region is located above the low wind velocity region in a direction of gravity, at least one first heat transfer tube is disposed in the high wind velocity region, and at least one second heat transfer tube is disposed in the low wind velocity region, a first header is connected to each of the first heat transfer tube and the second heat transfer tube, the first header has a first internal space to which the first heat transfer tube and the second heat transfer tube are commonly connected, when using the heat exchanger as a condenser, a gas-liquid two-phase refrigerant that has flowed out from the first heat exchange part flows into the first internal space of the first header, and then the refrigerant flows into each of the first heat transfer tube and the second heat transfer tube from the first internal space, the first header is provided with an inlet into which the gas-liquid two-phase refrigerant that has flowed out from the first heat exchange part flows, and the inlet is disposed in the low wind velocity region.

2. The indoor unit of an air conditioner according to claim 1, further comprising a casing that houses the heat exchanger and includes an inlet port into which the air is inhaled and an outlet port from which the air is blown out; and an indoor fan that is housed in the casing, inhales the air via the inlet port, and blows out the air that passes through the heat exchanger via the outlet port, the casing including a guide plate that guides the air that passes through the heat exchanger to the outlet port, the guide plate being provided between the low wind velocity region of the second heat exchange part and the fan.

3. The indoor unit of an air conditioner according to claim 1, further comprising a casing that houses the heat exchanger and includes an inlet port into which the air is inhaled and an outlet port from which the air is blown out, the casing including a drain pan that collects condensed water flowing down from the second heat exchange part, the low wind velocity region being located closer to the drain pan than the high wind velocity region.

4. The indoor unit of an air conditioner according to claim 1, wherein the first heat exchange part includes a second header that allows the refrigerant to flow out when the heat exchanger is used as a condenser, the second header has a plurality of second internal spaces divided by at least one partition plate, and a volume of the first internal space is larger than each of volumes of the plurality of second internal spaces.

5. The indoor unit of an air conditioner according to claim 4, wherein each of the plurality of second internal spaces is connected to the first internal space via a pipe.

* * * * *